US005090484A

United States Patent [19]

Theurer et al.

[11] Patent Number: 5,090,484

[45] Date of Patent: Feb. 25, 1992

[54] MOBILE BALLAST CLEANING MACHINE ARRANGEMENT

[75] Inventors: Josef Theurer, Vienna; Friedrich Oellerer, Linz, both of Austria

[73] Assignee: Franz Plasser Bahnbaumaschinen-Industriegesellschaft M.B.H., Vienna, Austria

[21] Appl. No.: 539,918

[22] Filed: Jun. 18, 1990

[30] Foreign Application Priority Data

Jul. 18, 1989 [AT] Austria ..... 1735/89

[51] Int. Cl.[5] ..... E01B 27/10

[52] U.S. Cl. ..... 171/16; 37/104; 37/84; 104/2; 104/7.1

[58] Field of Search ..... 104/2, 7.1; 171/16; 37/104, 105, 106, 107, 84

[56] References Cited

U.S. PATENT DOCUMENTS

| | | | |
|---|---|---|---|
| 3,179,062 | 4/1965 | Christoff | 104/7.3 |
| 3,957,000 | 5/1976 | Plasser et al. | 104/2 |
| 3,976,142 | 8/1976 | Plasser et al. | 104/2 |
| 4,043,398 | 8/1977 | Fölser et al. | 104/7.1 |
| 4,266,615 | 5/1981 | Theurer et al. | 104/2 |
| 4,430,944 | 2/1984 | Theurer | 104/2 |
| 4,432,284 | 2/1984 | Theurer et al. | 104/2 |
| 4,538,687 | 9/1985 | Theurer et al. | 104/2 |
| 4,705,115 | 11/1987 | Whitaker, Jr. . | |
| 4,799,430 | 1/1989 | Theurer | 104/2 |
| 4,809,614 | 3/1989 | Theurer et al. | 104/7.2 |
| 4,911,246 | 3/1990 | Theurer et al. | 104/7.1 |

FOREIGN PATENT DOCUMENTS

| | | | |
|---|---|---|---|
| 159186 | 2/1983 | German Democratic Rep. | 104/2 |
| 970010 | 1/1962 | United Kingdom . | |

OTHER PUBLICATIONS

Railway Track & Structures, Oct. 1987, pp. 17–21.

*Primary Examiner*—Randolph A. Reese
*Assistant Examiner*—Spencer Warnick
*Attorney, Agent, or Firm*—Collard, Roe & Galgano

[57] ABSTRACT

A mobile machine arrangement for excavating ballast from a ballast bed, for cleaning the excavated ballast and for redistributing the cleaned ballast to the ballast bed, comprises a first, elongated machine frame and a second machine frame supported for mobility on a track. Mounted on the first machine frame are a track lifting device, a ballast excavating chain including a transverse course insertable in a central ballast bed portion under the track for excavating ballast from the central ballast bed portion, and a first ballast cleaning screen arranged to receive the excavated ballast from the excavating chain. The second machine frame precedes the first machine frame in the operating direction and is linked thereto, and mounted on the second machine frame are a ballast excavating device at each side of the track for excavating ballast from each ballast bed shoulder portion and for conveying the excavated shoulder ballast, a second ballast cleaning screen preceding the first ballast cleaning screen in the operating direction and arranged to receive the conveyed ballast from the ballast excavating devices. A respective ballast redistributing conveyor is arranged for receiving the cleaned ballast portion from each ballast cleaning screen and for redistributing the cleaned ballast portion in a respective ballast bed portion behind the transverse ballast excavating chain course in the operating direction, and another conveyor is mounted on the first and second machine frames for selectively receiving the waste portions from the first and second ballast screens and for conveying the received waste portions forwardly in the operating direction along a conveying path.

12 Claims, 2 Drawing Sheets

MOBILE BALLAST CLEANING MACHINE ARRANGEMENT

BACKGROUND OF THE INVENTION

1. Field of the Invention

The present invention relates to a mobile machine arrangement for excavating ballast from a ballast bed including a central portion supporting a railroad track and a respective shoulder portion at each side of the track, for cleaning the excavated ballast and for redistributing the cleaned ballast to the ballast bed, which comprises at least one machine frame supported on undercarriages for mobility on the track in an operating direction, a ballast excavating chain including a transverse course insertable in the central ballast bed portion under the track for excavating ballast from the central ballast bed portion and an ascending course for conveying the excavated ballast, a first ballast cleaning screen arranged to receive the conveyed ballast from the ascending course of the ballast excavating chain and to separate the ballast into a cleaned portion and a waste portion, a ballast excavating device preceding the ballast excavating chain in the operating direction at each side of the track for excavating ballast from each ballast bed shoulder portion and for conveying the excavated shoulder ballast, a second ballast cleaning screen arranged to receive the conveyed shoulder ballast from the ballast excavating devices and to separate the ballast into a cleaned portion and a waste portion, ballast conveyor means for redistributing the cleaned ballast portions and for removing the waste portions.

2. Description of the Prior Art

During the last few years, the cleaning and rehabilitation of railroad track supporting ballast beds has become more difficult not only because the rehabilitation work requires train traffic to be stopped and thus to interrupt the ever more frequent schedules but also because economical considerations make it desirable to clean not only the upper ballast layer but at the same time to clean the entire ballast bed down to the subgrade in a single operation while the track is lifted. This considerably increases the amount of ballast that must be handled by the machine and correspondingly decreases the output, i.e. the speed of advance, of such ballast cleaning machines.

In substance, rehabilitation of the railroad track ballast bed comprises excavating the dirty or encrusted ballast, cleaning the excavated ballast, returning and redistributing the cleaned ballast, and conveying the waste away from the rehabilitation site. This has been done with mobile ballast cleaning machines of the above-described type. The transverse course of the ballast excavating chain extending under the raised track generally excavates the ballast across the entire ballast bed width in a single pass, which forces the machine to advance only very slowly even if its maximal operating capacity is used. The forward speed of the machine decreases in proportion to the depth of excavation, i.e. the amount of ballast being excavated. Furthermore, because of the very inconvenient train traffic interruption caused by the track rehabilitation work, the work is performed relatively rarely so that the ballast becomes heavily encrusted, preventing drainage and making the ballast cleaning more difficult. It has been proposed to facilitate drainage without cleaning the ballast along the entire ballast bed width by using shoulder ballast cleaning machines using shoulder ballast excavating devices at each side of the track. Such machines work at a forward speed somewhat exceeding that of mobile ballast cleaning machines designed to recondition the ballast along the entire width of the ballast bed.

U.S. Pat. No. 4,538,687, dated Sept. 3, 1985, discloses a mobile ballast cleaning machine designed to excavate ballast along the entire width of the ballast bed and, to increase its output, the machine is equipped with a double ballast cleaning screen and an auxiliary conveying chain for conveying the excavated ballast from the transverse course of the ballast excavating chain extending under the raised track to the screen. This makes it possible to clean a larger volume of ballast at an increased forward speed of the machine. A track lifting device is arranged immediately adjacent the transverse excavating chain course and the excavated ballast is conveyed to the double ballast cleaning screen arrangement by the ascending course of the chain and by the auxiliary conveying chain, thus greatly increasing the capacity of the machine. The transverse excavating chain course excavates and conveys the dirty ballast to the shoulder while creating an excavated ballast bed gap under the raised track, and the ascending excavating chain course and the auxiliary conveying chain convey the excavated ballast to the ballast cleaning screen arrangement. During the ballast reconditioning operation and forward movement of the machine, the track is continuously raised so that it is possible to use an excavating chain of a larger or smaller operating height under the track, depending on the desired depth of excavation. The cleaned portion of the ballast is conveyed from the double ballast cleaning screen arrangement and redistributed immediately behind the transverse excavating chain course in the excavated ballast bed gap while the waste portion is conveyed from the screen arrangement by a conveyor arrangement to freight cars preceding the mobile ballast cleaning machine in the operating direction. This machine has been successfully used and provides high-efficiency reconditioning of a ballast bed.

British patent No. 970,010, published Sept. 16, 1964, discloses a mobile ballast cleaning machine arrangement comprising two machines coupled to each other for common movement in an operating direction, each machine comprising a machine frame supported on two undercarriages with a relatively short wheel base, the leading machine being equipped with two shoulder ballast excavating devices with an associated ballast cleaning screen and the trailing machine being equipped with a ballast excavating chain having a transverse chain course insertable under the track and an associated ballast cleaning screen, and each machine also having conveyor means for redistributing the cleaned ballast and for removing the waste from the respective ballast cleaning screens. This machine arrangement, which has no track lifting means, enables the ballast from the center portion and the shoulder portions of the ballast bed to be excavated and cleaned in a single pass, and a common conveyor band enables the redistributing means on the trailing machine to redistribute the cleaned ballast in the ballast bed gap excavated by the transverse ballast excavating chain course. When the shoulder ballast excavating machine is used alone, the excavated shoulder ballast is cleaned and the cleaned ballast is redistributed by discharge chutes at the same shoulder. When the machines are coupled together, the forward speed of the machine arrangement is quite slow.

U.S. Pat. No. 4,705,115, dated Nov. 10, 1987, discloses a structurally complex mobile ballast reconditioning machine with two shoulder ballast excavating ditcher wheels preceding a relatively wide undercutter revolving in a transverse plane extending vertically with respect to the track axis for excavating ballast from beneath the track. The relatively large ditcher wheels excavate the shoulder ballast and convey it up to a level extending at about half the height of the machine whence it is conveyed across the rails towards the center of the track by transversely extending conveyor bands and thence by conveyor bands extending in the track direction across the endless undercutter chain to be discharged immediately behind the undercutter on the center portion of the ballast bed without being cleaned. The ballast excavated by the undercutter is conveyed to a ballast screen cleaner and the cleaned ballast is discharged in the excavated track shoulders. In other words, only the ballast from the center portion of the ballast bed beneath a track which is not raised is cleaned with this machine while the shoulder ballast excavated by relatively complex bucket conveyors and conveyed by cumbersome conveyor arrangements is redistributed to the center portion of the ballast bed without being cleaned.

Finally, an article in "Railway Track & Structures", October 1987, pages 17, 18, 20 and 21, discloses a ballast cleaning system comprised of two independently movable ballast cleaning machines. The leading machine is one according to U.S. patent No. 4,705,115, with two shoulder ballast excavating ditcher wheels and a centrally arranged ballast cleaning screen. The shoulder ballast excavated by the ditcher wheels is conveyed to the ballast cleaning screen arrangement and is conveyed therefrom to the shoulders for intermediate storage. The cleaned ballast is then received by the two ditcher wheels on the trailing machine, is conveyed across the track rails and back beyond the undercutter on this machine to be deposited below the track, which has not been raised, in the ballast bed gap excavated by the undercutter chain in the center of the ballast bed. The ballast excavated by the undercutter in the center of the ballast bed is cleaned and the cleaned ballast is discharged in the excavated track shoulders. Thus, the two large ditcher wheels with the two transverse conveyor bands and the longitudinally extending conveyor band reaching at half the height of the machine beyond the transversely extending undercutter constitute a device in a mobile ballast cleaning machine for receiving a ballast portion preceding the undercutter and for depositing this ballast portion in the gap of the ballast bed excavated by the undercutter. The entire system is structurally quite complex and requires four large ditcher wheels, two depositions of the cleaned ballast laterally of the track and two complex redistributions thereof, as well as a time-and labor-consuming vertical, transverse and longitudinal ballast conveyance beyond the endless undercutter chain while affording no increase in the efficiency of the machine and its rapid forward movement in view of the fact that the track is not raised during the ballast reconditioining operation.

SUMMARY OF THE INVENTION

It is the primary object of this invention to provide a mobile machine of the first-described type which enables the ballast reconditioning to be effected under various ballast conditions with an enhanced ballast cleaning capacity.

The above and other objects are accomplished according to the invention with a mobile ballast reconditioning machine arrangement which comprises a first, elongated machine frame supported for mobility on the track in an operating direction on two widely spaced undercarriages and a second machine frame preceding the first machine frame and linked thereto. Mounted on the first machine frame are a track lifting device, a ballast excavating chain including a transverse course insertable in the central ballast bed portion under the track for excavating ballast from the central ballast bed portion and an ascending course for conveying the excavated ballast, and a first ballast cleaning screen arranged to receive the conveyed ballast from the ascending course of the ballast excavating chain and to separate the ballast into a cleaned portion and a waste portion. Mounted on the second machine frame are a ballast excavating device at each side of the track for excavating ballast from each ballast bed shoulder portion and for conveying the excavated shoulder ballast, and a second ballast cleaning screen preceding the first ballast cleaning screen in the operating direction and arranged to receive the conveyed ballast from the ballast excavating devices and to separate the ballast into a cleaned portion and a waste portion. A respective ballast redistributing conveyor means is arranged for receiving the cleaned ballast portion from each ballast cleaning screen and for redistributing the cleaned ballast portion in a respective one of the ballast bed portions behind the transverse ballast excavating chain course in the operating direction, and a conveyor means is arranged for selectively receiving the waste portions from the first and second ballast screens and for conveying the received waste portions forwardly in the operating direction along a conveying path, the conveyor means being mounted on the first and second machine frames and including at least one laterally pivotal conveyor band.

With the increased ballast cleaning capacity provided by two ballast cleaning screens, the enhanced excavating and conveying capacity of the ballast excavating chain and the two shoulder ballast excavating devices, and the respective ballast redistributing means associated with each ballast cleaning screen for redistributing the cleaned ballast to the desired gaps in the ballast bed excavated by the excavating chain and devices while the track is raised off the bed, this machine arrangement attains not only an increased output during a more rapid forward movement but unexpectedly achieves a better ballast reconditioning quality because it makes it possible to adapt the machine operation to the prevalent ballast and track conditions. The higher operating speed of this machine arrangement cuts the down-time of the track during the ballast reconditioning operations, which has great economical advantages and makes it possible to recondition ballast more frequently than was heretofore economically feasible.

Incorporating a track lifting device in such a machine arrangement with its conveyor means for redistributing the cleaned ballast from each ballast cleaning screen makes the machine arrangement particularly efficient since the raised track enables the ballast therebelow to be excavated more efficiently with the transverse excavating chain course inserted beneath the raised track and the cleaned ballast can be conveyed from each screen more rapidly and efficiently. Furthermore, this arrangement has the great advantage of being readily adapted to various ballast and track conditions since varying amounts of dirty ballast in the shoulders and/or the center of the ballast bed may be readily replaced by cleaned ballast according to local requirements. The conveyance path for transporting the waste portion from the ballast cleaning screens to preceding freight cars extends along the entire machine arrangement and thus simplifies the removal of the waste.

BRIEF DESCRIPTION OF THE DRAWING

The above and other objects, advantages and features of this invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figures 1, 2, 3, 4, 5, 6:
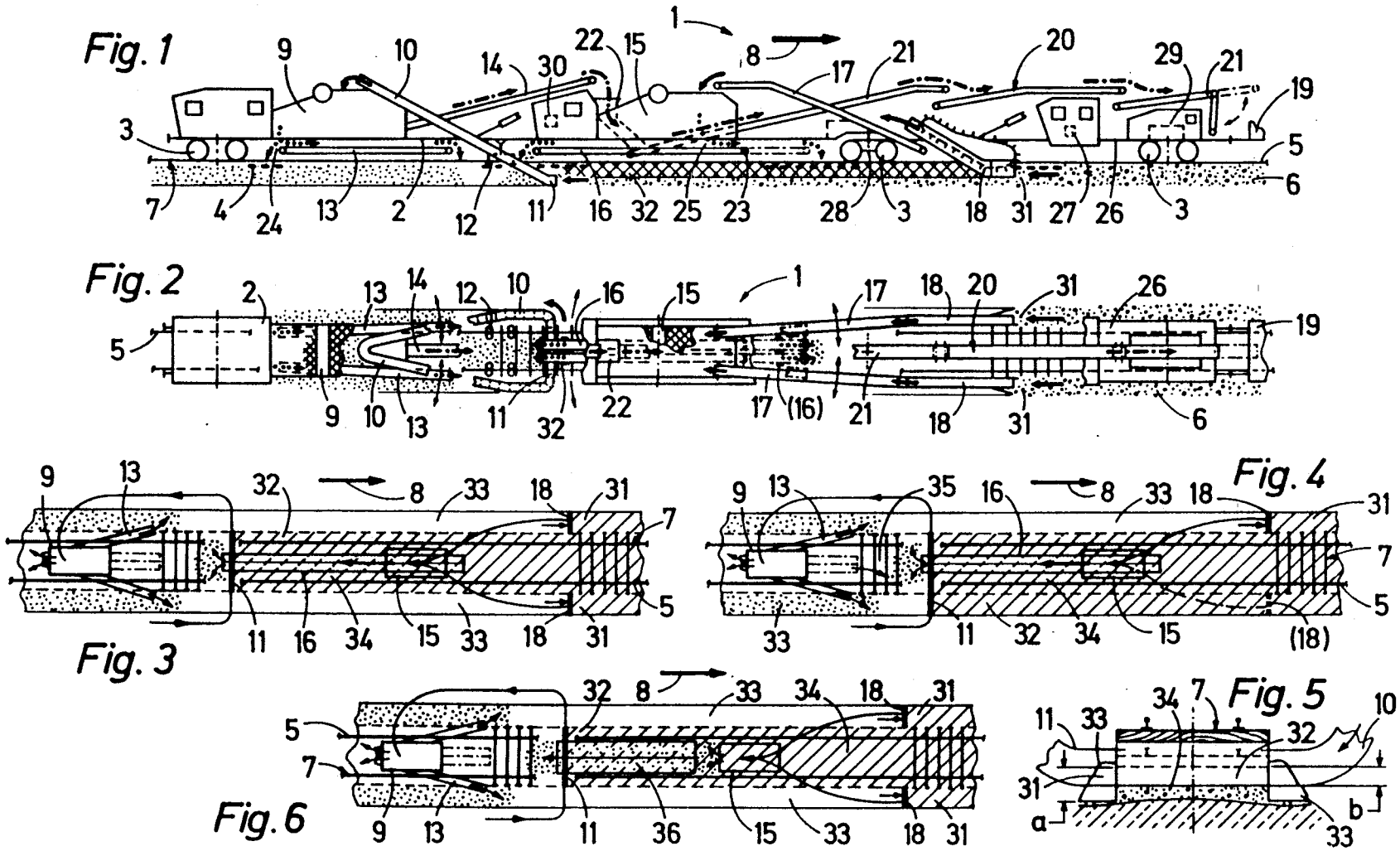
FIG. 1 is a diagrammatic side elevational view of one embodiment of the mobile machine arrangement according to the invention.
FIG. 2 is a top view of this machine arrangement.
FIGS. 3 and 4 are respective fragmentary and diagrammatic top views of the machine arrangement of FIGS. 1 and 2, the positions of the transverse ballast excavating chain course under the track and of the shoulder ballast excavating devices being indicated in heavy black lines and the ballast flow being indicated by arrows.
FIG. 5 is a diagrammatic cross section showing the ballast bed and the track raised in the range of the transverse ballast excavating chain course, with different excavating depths.
FIG. 6 is a view similar to that of FIGS. 3 and 4, illustrating a modification of this embodiment of the machine arrangement.

Referring now to the drawing and first to FIGS. 1 and 2, there is shown a mobile machine arrangement 1 for excavating ballast from ballast bed 6 including a central portion supporting railroad track 7 and a respective shoulder portion at each side of the track, for cleaning the excavated ballast and for redistributing the cleaned ballast to the ballast bed. Track 7 is comprised of rails 5 fastened to tie 4. Machine arrangement 1 comprises a first, elongated machine frame 2 supported for mobility on track 7 in an operating direction (indicated by arrow 8) on two widely spaced undercarriages 3, 3. Mounted on first machine frame 2 are vertically adjustable track lifting device 12, ballast excavating chain 10 including transverse course 11 insertable in the central ballast bed portion under track 7 for excavating ballast from the central ballast bed portion and an ascending course for conveying the excavated ballast, and first ballast cleaning screen 9 arranged to receive the conveyed ballast from the ascending course of the ballast excavating chain and to separate the ballast into a cleaned portion and a waste portion. The generally conventional vibratory ballast cleaning screen 9 is mounted on the rear section of elongated machine frame 2 and, as is also conventional, drive means are linked to ballast excavating chain 10 for vertically and laterally adjusting the chain with respect to ballast bed 6, track lifting device 12 being arranged adjacent transverse course 11 of the chain immediately rearwardly thereof in the operating direction.

A second machine frame 26 precedes first machine frame 2 in the operating direction and is linked thereto. Mounted on the second machine frame are a ballast excavating device 18, 18 at each side of the track for excavating ballast from each ballast bed shoulder portion and for conveying the excavated shoulder ballast. Drive means are also linked to the ballast excavating devices for vertically and laterally adjusting them with respect to the ballast bed and to position them suitably in conformity to an inclination of the ballast bed shoulders. A second ballast cleaning screen 15 precedes first ballast cleaning screen 9 in the operating direction and is arranged to receive the conveyed ballast from ballast excavating devices 18, 18 and to separate the ballast into a cleaned portion and a waste portion. Ballast cleaning screens 9, 15 have outputs 24, 25 at their undersides for discharging cleaned ballast onto ballast bed 6 after track 7 has been lowered onto the ballast bed comprised of the redistributed cleaned ballast.

The machine further comprises a respective ballast redistributing means respectively including two conveyor bands 13, 13 arranged under ballast cleaning screen 9 and two conveyor bands arranged under ballast cleaning screen 15. Each ballast redistributing means is arranged for receiving the cleaned ballast portion from the respective ballast cleaning screen 9, 15 and for redistributing the cleaned ballast portion in a respective one of the ballast bed portions behind transverse ballast excavating chain course 11 in the operating direction. In the embodiment of FIGS. 1 and 2, second ballast cleaning screen 15 and the ballast redistributing means are mounted on first machine frame 2, and the ballast redistributing means includes first conveyor bands 13, 13 arranged under first ballast cleaning screen 9 rearwardly of transverse ballast excavating chain course 11 and connected to a drive for laterally pivoting the conveyor bands about a vertical axis in a plane extending substantially parallel to the ballast bed for selectively redistributing the cleaned ballast portions in a respective ballast bed portion while the track is lifted, and second conveyor bands 16, 16 arranged to receive the cleaned ballast from second ballast cleaning screen 15 for redistributing the cleaned ballast at least in the center ballast portion.

Furthermore, machine arrangement 1 comprises a conveyor means including conveyor bands 14, 21 arranged for selectively receiving the waste portions from first and second ballast screens 9, 15 and for conveying the received waste portions forwardly in the operating direction along conveying path 20, the waste portion conveyor bands being mounted on the first and second machine frames 2, 26 and including at least one laterally pivotal conveyor band. In the illustrated embodiment, machine arrangement 1 further comprises open-topped freight cars 19 preceding second machine frame 26 in the operating direction and arranged to receive the forwardly conveyed waste portions from conveyor means 14, 21.

A machine arrangement incorporating the above-described features is not only structurally robust and relatively simple to build so that manufacturing costs do not exceed the costs for manufacturing conventional mobile ballast cleaning machines but has the unexpected advantage of being operable as a universal ballast cleaner adaptable with highest efficiency to a great number of different ballast reconditioning operations. This machine arrangement for the first time makes it possible in a single ballast cleaning pass selectively to receive excavated ballast from a leading ballast bed portion on which the track rests while simultaneously receiving excavated ballast from a trailing ballast bed portion from which the track has been lifted, and to redistribute the cleaned ballast selectively to any excavated portion of the ballast bed, for example in the following operating modes at least partially and diagrammatically illustrated in FIGS. 1 to 6:

(a) The cleaned portion of the shoulder ballast excavated by ballast excavating devices 18, 18 may be redistributed by conveyor bands 16, 16 in center portion 34 of ballast bed 6 while the cleaned portion of the ballast excavated by transverse excavating chain course 11 from the ballast bed center portion may be redistributed by laterally pivotal conveyor bands 13, 13 in shoulders 33 of the ballast bed.

(b) Ballast may be excavated only from one shoulder portion, particularly by relieving the ballast excavating chain at the desired side of the track, and the cleaned portion of this excavated shoulder ballast may be redistributed in the center ballast bed portion.

(c) Ballast may be excavated selectively from one or the other shoulder 33 by the one or the other ballast excavating device 18, for example in track curves exhibiting high superelevation, to relieve ballast excavating chain 10 at the selected side since the excavating work of the chain is particularly difficult in sharp curves because of the excess amount of ballast at the superelevated shoulder.

(d) The cleaned portion of the shoulder ballast selectively excavated by one or both ballast excavating devices 18, 18 may also be temporarily deposited or stored in center portion 34 of ballast bed 6 and then redistributed in the excavated center portion 35 of the ballast bed beneath the lifted track by a device traversing transverse excavating chain course 11.

(e) The cleaned portion of the shoulder ballast may be redistributed in the center ballast bed portion and that of the excavated center ballast bed portion may be redistributed in shoulders 33 adjacent the raised track as well as in the center ballast bed portion in the lowered track section.

(f) In any of these selected operations, the excavating depth of ballast excavating chain 10 and of ballast excavating devices 18 may be so controlled that the ballast will be removed down to the desired depth, for example by excavating more ballast from the shoulders than from the center ballast bed portion under the raised track, which not only enhances the operating efficiency considerably but also advantageously can adapt the operation to various ballast and track conditions.

(g) The cleaned portion of the ballast excavated from one or both shoulders 33 may be only partially redistributed in center ballast bed portion 35 and partially in one of the shoulders 33 adjacent the raised track.

(h) Finally, depending on the ballast conditions and while machine arrangement 1 advances continuously along track 7, ballast may be excavated from one or both shoulders and the cleaned portion of the excavated ballast may be redistributed selectively in respective portions of ballast bed 6 under the raised track section, particularly in sharp curves where more or less reballasting is required, depending on the ballast volume to the left or the right of the track.

These and other operating modes can be used also in ballast beds of relatively small volume so that ballast may be redistributed from the shoulders to the center portion of the ballast bed where additional ballast is required for proper tamping of the ties. The lateral pivoting of rear ballast redistributing conveyor bands 13, 13 makes it possible to control the amount of cleaned ballast redistributed to the center portion of the ballast bed and/or to the shoulder portions thereof. The conveyance path for conveying the waste portions coming from ballast cleaning screens 9 and 15 extends along the entire length of the machine arrangement to enable the entire waste to be removed.

Second ballast redistributing conveyor bands 16 may be laterally pivotal, as indicated by small arrows in FIG. 2. They are endless bands and comprise reversing drives 23 for moving the endless conveyor bands in either direction. They are independently displaceable in the direction of track elongation for placing a discharge end of one or both conveyor bands rearwardly of transverse excavating chain course 11, i.e. as shown in chain-dotted and full lines in FIG. 1, the conveyor bands may be displaced between positions wherein the conveyor band front ends are located immediately behind intermediate undercarriage 3 and the conveyor band rear ends are located immediately behind transverse excavating chain course 11. This simple arrangement of the cleaned ballast redistributing conveyor bands enables them to be used for discharging the cleaned ballast at any selected location, and this may be done rapidly by operation of reversing drive 23 and/or by the longitudinal displacement of the conveyor bands.

In the illustrated embodiment, the waste portion conveyor means comprises chute 22 arranged in conveying path 20 extending from first ballast cleaning screen 9 along machine frames 2, 26 forwardly in the operating direction. Second ballast cleaning screen 15 comprises a shaft arranged to receive oversized ballast rocks conveyed thereto with the excavated shoulder ballast by conveyors 17, 17 and the shaft forms chute 22, which is arranged in conveying path 20 for discharging onto conveyor band 21 of the waste portion conveyor means mounted under the second ballast screening screen. This arrangement simplifies the conveyance of the waste portions through parts of the machine arrangement which are overcrowded with structural components, such as a ballast cleaning screen, and, in particular, makes use of the shaft provided in ballast cleaning screens for receiving and thus separating oversized ballast rocks or other oversized debris which may have been excavated and fed to the screen. It is, of course, also possible to remove the waste portions to freight cars positioned on an adjacent track by providing laterally pivotal conveyors in conveying path 20.

As shown in FIGS. 1 and 2, second machine frame 26, which is pivotally coupled to first machine frame 2, carries an operator's cab housing control panel 27, from which shoulder ballast excavating devices 18, 18 may be operated independently or in unison. Machine frame 26 also supports common power plant 29 which provides power for all operating drives of machine arrangement 1, including drive 28 propelling the machine arrangement in the operating direction. First machine frame 2 carries an operator's cab housing control panel 30 for operating ballast excavating chain 10. As shown by arcuate double arrows in FIG. 2, cleaned ballast redistributing conveyor bands 13 and 16 are pivotal about vertical axes so that the cleaned ballast may be selectively discharged in the center portion and/or the shoulder portions of ballast bed 6.

Various operating modes which may be carried out with the above-described machine arrangement will now be further elucidated in connection with the schematic illustrations of FIGS. 3 to 6.

In all operating modes, machine arrangement 1 advances continuously along track 7 in the operating direction indicated by arrow 8. In the operation shown in FIG. 3, shoulder ballast excavating devices 18, 18 excavate ballast from shoulders 33 in leading track section 31, where track 7 is supported on ballast bed 6, and ballast excavating chain 10 excavates ballast from center portion 34 in trailing track section 32, where the track is raised off the ballast bed by track lifting device 12. An ascending course of endless ballast excavating chain 10 feeds the ballast excavated by transverse course 11 to first ballast cleaning screen 9 and conveyors 17, 17 feed the shoulder ballast excavated by excavating devices 18, 18 to second ballast cleaning screen 15 where the excavated ballast is cleaned, i.e. separated into a clean portion and a waste portion. The cleaned ballast portion from ballast cleaning screen 15 is redistributed in center ballast bed portion 34 and the cleaned ballast portion from ballast cleaning screen 9 is redistributed in shoulders 33. At the same time, the waste portions from both ballast cleaning screens are conveyed along conveying path 20, as indicated by heavy chain-dotted arrows in FIG. 1. The cleaned ballast portion is discharged through output 25 of second ballast cleaning screen 15 onto redistributing conveyor bands 16, 16, which have been longitudinally displaced into their rear end positions wherein they bridge tranverse excavating chain course 11 and their rear ends discharge the cleaned ballast in the center portion of the ballast bed excavated by the transverse excavating chain course. At the same time, ballast redistributing conveyor bands 13, 13 are laterally pivoted to discharge the cleaned ballast coming from first ballast cleaning screen 9 in excavated shoulders 33

The operation shown in FIG. 4 proceeds similarly but the shoulder ballast may be excavated by only one excavating device 18 (shown in full lines) while the excavating device shown in broken lines remains idle. If the shoulder ballast excavating devices are operated in the illustrated manner, only that device 18 is operated which excavates shoulder 33 on the side of track 7 at the discharge end of transverse excavating chain course 11 where the ascending course of endless excavating chain 10 receives the excavated ballast and conveys it to ballast cleaning screen 9. The transverse excavating chain course is extended at its intake end opposite the discharge end to extend over opposite shoulder 33 in track section 32 so that the ballast in this shoulder is excavated by chain 10 at the same time as it excavates center portion 34 of the ballast bed. Whether ballast is excavated from one or both shoulders 33, the excavated shoulder ballast is cleaned and the cleaned ballast portion is redistributed in center portion 34 of the ballast bed in trailing track section 32 while the ballast in the center portion (and possibly at the intake end at one shoulder) is excavated by transverse excavating chain course 11 and cleaned, the cleaned ballast portion being redistributed under raised track 7 in shoulders 33 and center portion 34 of excavated ballast bed section 35, as well as through outlet 24 (see FIG. 1) in a trailing track section where the track is supported on a redistributed layer of cleaned ballast.

On the other hand, it is also possible to excavate only one shoulder by ballast excavating device 18 shown in broken lines, for example the outer, superelevated shoulder of a track curve, which has a large volume of ballast. This will considerably relieve the trailing ballast excavating chain and thus improve its excavating capacity In all operating modes, the excavated shoulder ballast and the ballast excavated from the center portion of the ballast bed are separately cleaned on ballast cleaning screens 15 and 9, respectively, and the cleaned ballast portions are redistributed in the excavated shoulders and center ballast bed portion by redistributing conveyor means 13, 16.

Other possibilities of redistributing the cleaned portion of the ballast excavated in leading track section 31 include the partial redistribution in ballast center portion 34 and in both shoulder portions 33 in raised track section 32, or selective redistribution of the excavated shoulder ballast by laterally pivotal conveyor bands 16 in ballast bed center portion 34 in order to take into account different local ballast conditions.

As will be seen in FIG. 5, it is also possible to excavate ballast from leading track section 31, where track 7 rests on the ballast bed (as shown in broken lines), as well as from trailing track section 32, where the track is raised by lifting device 12, at different excavation depths or ballast bed thicknesses a and b. This can be done very simply while the machine arrangement continuously advances along track 7 by so controlling the vertical adjustment drives of ballast excavating chain 10 and ballast excavating devices 18 by controls 27 and 30 that the desired excavation depth is obtained. More particularly and if desired, more ballast may be excavated from shoulders 33 in track section 31 than from center portion 34 in track section 32, i.e. the excavation depth in the former ma exceed that in the latter. This will not only improve the operating efficiency but also makes it possible to adjust the reconditioning operation rapidly to varying ballast conditions.

In the modified embodiment of FIG. 6, the ballast redistributing conveyor means comprises a plate-shaped ballast separating device 36 replacing conveyor bands 16, 16 and arranged to receive the cleaned ballast portion from second ballast cleaning screen 15 which receives the ballast excavated from one or both shoulders 33 in track section 31, where the track rests on ballast bed 6. As shown by the two small arrows immediately behind screen 15 in FIG. 6, this cleaned ballast portion is temporarily stored in center portion 34 on top of the ballast bed and, as the machine arrangement continues to advance, it is then separated by plate-shaped separating device 36 from the underlying ballast in the center portion before it is excavated by transverse excavating chain course 11, the plate-shaped ballast separating device extending beyond the transverse excavating chain course in the operating direction whereby the temporarily stored cleaned ballast portion is redistributed in the center portion of the ballast bed after the same has been excavated. At the same time, the ballast in the center portion between track rails 5 and below the track plane is excavated in trailing track section 32 by ballast excavating chain 10, while this track section is raised, this excavated ballast is cleaned in ballast cleaning screen 9 and the cleaned ballast portion is redistributed from this screen to excavated shoulders 33 by laterally pivotal conveyor bands 13, 13. This modified arrangement also enables all the above-described operating modes to be carried out.

Machine arrangement 37 illustrated in FIGS. 7, 7*a*, 7*b* and 8 is comprised of ballast cleaning machine 38 and shoulder ballast cleaning machine 39 coupled together to form train 40 mounted for mobility on track 43 in an operating direction indicated by arrow 44. The track is comprised of rails 42 fastened to ties 41. In this embodiment of the machine arrangement, the trailing ballast cleaning machine comprises elongated machine frame 54 supported for mobility on the track in the operating direction on two widely spaced undercarriages 63, 63. Mounted on machine frame 54 is track lifting device 47, endless ballast excavating chain 46 and vibratory ballast cleaning screen 48. Ballast excavating chain 10 includes transverse course 55 insertable in the central ballast bed portion under track 43 for excavating ballast from the central ballast bed portion and an obliquely ascending course for conveying the excavated ballast, ballast cleaning screen 48 being arranged to receive the conveyed ballast from the ascending course of ballast excavating chain 46 and to separate the ballast into a cleaned portion and a waste portion. Drives 45 are linked to the ballast excavating chain for vertical and lateral adjustment thereof with respect to the ballast bed.

Shoulder ballast excavating machine 39 has machine frame 67 preceding the machine frame 54 in the operating direction and linked thereto. Machine frame 67 is comprised of a leading part and a trailing part, the two machine frame parts being coupled together for laterally pivoting with respect to each other in a plane extending substantially parallel to track 43, and this machine frame is supported on the track by three undercarriages 66. Mounted on machine frame 67 are ballast excavating device 69 at each side of the track for excavating ballast from each ballast bed shoulder portion 77 and for conveying the excavated shoulder ballast, and second vibratory ballast cleaning screen 70 preceding the first ballast cleaning screen in the operating direction is mounted on machine frame 67 and is arranged to receive the conveyed ballast from ballast excavating devices 69, 69 and to separate the ballast into a cleaned portion and a waste portion. Respective ballast redistributing conveyor bands 49 and 72 are arranged under each ballast cleaning screen. Ballast cleaning screen 48 also has a discharge chute 50 which may be operated to discharge a selected part of the cleaned ballast portion. Each ballast redistributing conveyor band is arranged for receiving the cleaned ballast portion from the respective ballast cleaning screen and for redistributing the cleaned ballast portion in a respective one of the ballast bed portions behind the transverse ballast excavating chain course in the operating direction.

Figures 7, 7A, 7B, 8:
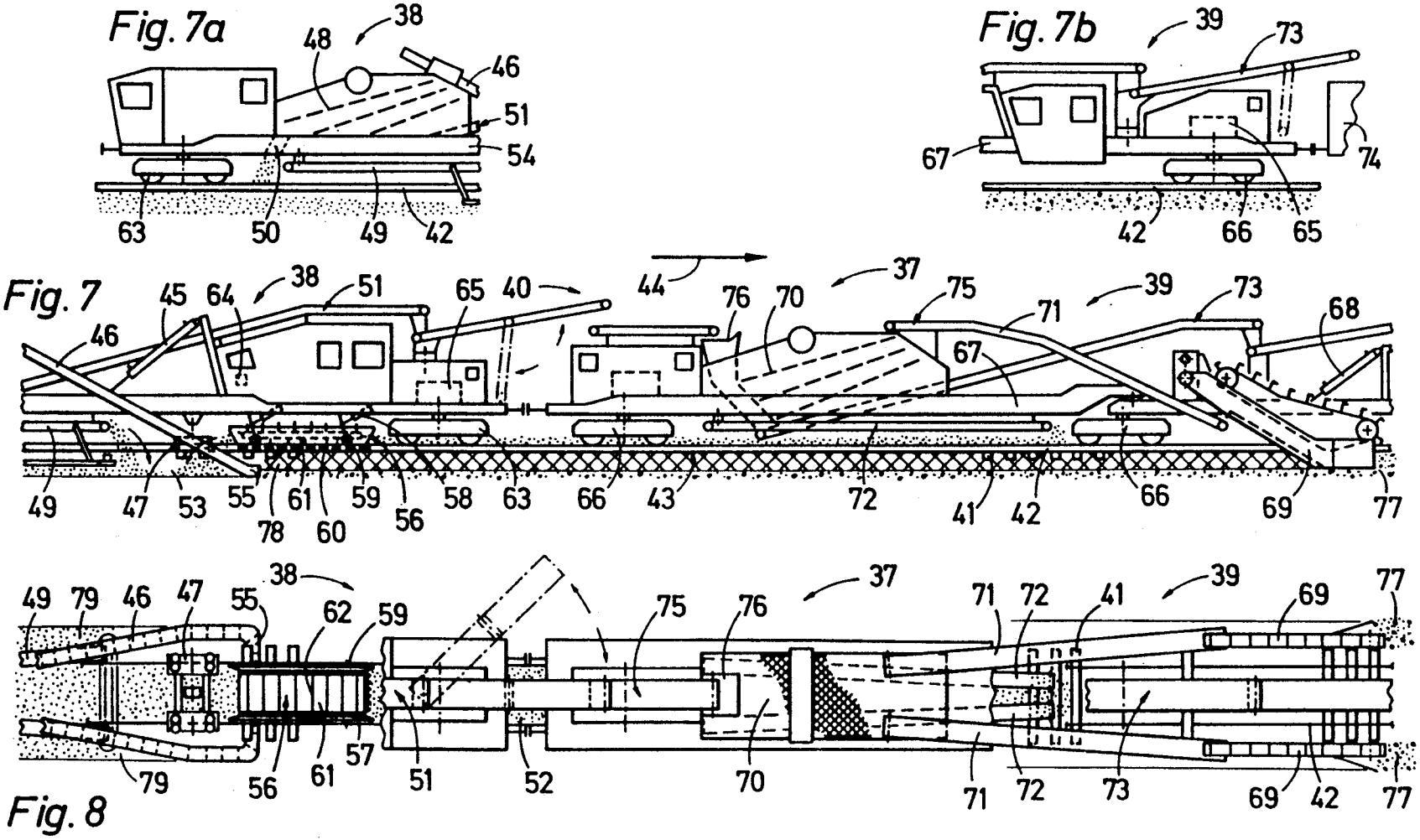
FIG. 7 is a side elevational view similar to the one of FIG. 1, showing another embodiment of the machine arrangement of the present invention, FIG. *7a* showing the rear end and FIG. *7b* the front end thereof.
FIG. 8 is a top view of the machine arrangement shown in FIG. 7.

In this embodiment, the ballast redistributing conveyor means further comprises vertically adjustable cleaned ballast portion separating device 56 mounted on machine frame 54 and extending between one undercarriage 63 and transverse ballast excavating chain course 55, and pairs of flanged wheels 59 support the cleaned ballast portion separating device for mobility on track 43. Cleaned ballast portion redistributing conveyor bands 72 under ballast cleaning screen 70 are arranged to redistribute the cleaned ballast portion received from ballast cleaning screen 70 to ballast bed center portion 52 (see FIG. 8) for intermediate storing while track 43 rests on this ballast bed center portion, and ballast separating device 56 is arranged to receive the intermediately stored cleaned ballast portion as machine arrangement 37 continuously advances in the operating direction and to redistribute this cleaned ballast portion in excavated ballast bed portion 53 behind the transverse excavating chain course. Specific embodiments of ballast separating devices have been described and claimed in our simultaneously filed U.S. patent application Ser. No. 539,782, entitled 'BALLAST SEPARATING DEVICE FOR BALLAST CLEANING MACHINE'. Machine arrangement 37 furthermore comprises conveyor means 51, 73 arranged for selectively receiving the waste portions from the first and second ballast screens 48, 70 and for conveying the received waste portions forwardly in the operating direction along conveying path 75, the conveyor means being mounted on the first and second machine frames. As shown in FIG. 7, the leading conveyor band of waste portion conveyor means 51 mounted on machine frame 54 is laterally and vertically adjustable about vertical and horizontal pivoting axes.

This arrangement has the advantage of making use of two available types of ballast cleaning machines which are converted at little cost to a combination machine capable of operating in the various modes described hereinabove. The cleaned ballast portion derived from the excavated shoulder ballast is temporarily stored in the center portion of the ballast bed and, as the combination machine advances continuously, it is received by device 56 which advances with the machine and separates the cleaned ballast portion from the underlying ballast bed whereon ballast cleaning screen 70 has deposited the cleaned ballast portion and then discharges the separated cleaned ballast portion in excavated center ballast bed portion 53 behind transverse excavating chain course 55.

Illustrated cleaned ballast portion separating device 56 comprises trough 57 open at its input and output ends for respectively receiving the cleaned ballast portion temporarily stored on center ballast bed portion 52 in the trough and for discharging this cleaned ballast portion in excavated center ballast bed portion 53. Drives 58 link separating device trough 57 to machine frame 54 for vertical adjustment of the separating device and flanged wheels 59 support the trough on track 43 raised by lifting device 47. Trough 57 has a flat bottom plate 60 extending immediately above track ties 41 between track rails 42 and supporting driven conveyor band 61 equipped with transverse ballast entrainment elements 62. As schematically shown in FIGS. 7 and 7*a*, a vertically adjustable ballast planing device is arranged on machine frame 54 of ballast cleaning machine 38 between widely spaced undercarriages 63, 63 underneath cleaned ballast portion redistributing conveyor bands 49. The ballast cleaning machine carries central power plant 65 supplying power to all the operating drives of machines 38 and 39, including a drive for propelling the machines in the operating direction. Control panel 64 on the ballast cleaning machine serves to control the operation of vertical and lateral adjustment drives 45 for ballast excavating chain 46. To enable shoulder ballast excavating machine 39 to operate independently of ballast cleaning machine 38, it carries its own power plant 65 to operate all of its operating drives where it may be desired to excavate only the track shoulders and to redistribute the cleaned portion of the excavated shoulder ballast.

In the illustrated embodiment, shoulder ballast excavating devices 69 are mounted at respective sides of the leading part of machine frame 67 and ballast cleaning screen 70 is mounted on the trailing machine frame part, the trailing machine frame part being coupled to first machine frame 54. Drives 68 link the shoulder ballast excavating devices to the leading machine frame part for vertical and lateral adjustment thereof. The excavated shoulder ballast is conveyed to vibratory ballast cleaning screen 70 by conveyor bands 71 mounted on the leading machine frame part and the waste portion is removed from screen 70 by conveyor bands 73 mounted on the leading machine frame part and conveying the waste portion to open-topped freight car 74 preceding machine arrangement 37. The ballast redistributing conveyor means includes conveyor bands 72 mounted on the trailing machine frame part under ballast cleaning screen 70 and arranged to redistribute the cleaned ballast portion for intermediate storing in center ballast bed portion 52. As in the embodiment of FIG. 1, chute 76 is arranged in waste portion conveying path 75 between conveyor band means 51 and conveyor band means 73, this chute also serving to receive oversized ballast rocks. An operator's cab is mounted at an end of the trailing machine frame part and a facing end of machine frame 54, and cleaned ballast portion separating device 56 is arranged on machine frame 54 immediately preceding ballast redistributing conveyor bands 49 under ballast cleaning screen 48 in the operating direction. This very robust and stable machine structure assures not only high efficiency and operating adaptability but a steady forward movement of the combination machine in tangent track and curves, as well as a very high excavating capacity useful particularly under conditions of considerable excavating depths.

The control means for the vertical adjustment drives of the ballast excavating chain and devices enable the excavating depths to be adapted to various ballast conditions, depending on the amount of ballast to be excavated from the shoulders and/or the center portion of the ballast bed. For example, it may be desired to excavate only a relatively thin upper layer of the center ballast bed portion, which is usually not very encrusted, and this may be done under the raised track with an excavating chain revolving efficiently at relatively high speed while a much larger volume of shoulder ballast, which is normally heavily encrusted, is excavated from one or both shoulders at lower speed.

Machine arrangement 37 may be operated in the following manner:

Shoulder ballast 77 is excavated by ballast excavating devices 69, the excavated shoulder ballast is conveyed by conveyor bands 71 to ballast cleaning screen 70 and the cleaned portion of the excavated ballast is discharged by cleaned ballast redistributing conveyor bands 72 in center ballast bed portion 52 for temporary storage on track 43 in this ballast bed portion. As the machine arrangement continuously advances along the track, the temporarily stored cleaned ballast portion will be separated from the underlying ballast bed, which has not yet been cleaned, and conveyor band 61, which is preferably driven at the same speed as the forward speed of the machine arrangement, entrains the cleaned ballast portion from ballast bed portion 52 to excavated ballast bed portion 53. The ballast excavated from ballast bed portion 78 by endless excavating chain 46 below raised track 46 is cleaned in screen 48 and the cleaned portion is discharged by laterally pivoted redistributing conveyor bands 49 in shoulders 79.

The hereinabove described operating modes are not the only ones possible with the machine arrangement of the present invention. For example, the wheel base of first machine frame 2 may be shortened if shorter redistributing conveyor bands 16, 16 are used, for instance, and second machine frame 26 may be moved closer to ballast cleaning screen 15. Also, elongated machine frame 2 may be a two-part frame, and the two machine frame parts may be linked together by vertical and lateral adjustment drives. Finally, it is also possible to modify the embodiment of FIG. 7 by substituting ballast redistributing conveyors extending from second machine frame 67 to transverse excavating chain course 55 for ballast separating device 56, in a manner similar to the embodiment of FIG. 1.

What is claimed is:

1. A mobile machine arrangement for excavating ballast from a ballast bed including a central portion supporting a railroad track and a respective shoulder portion at each side of the track, for cleaning the excavated ballast and for redistributing the cleaned ballast to the ballast bed, which comprises:

(a) a first, elongated machine frame supported for mobility on the track in an operating direction on two widely spaced undercarriages, and mounted on the first machine frame
  (1) a track lifting device,
  (2) a ballast excavating chain including a transverse course insertable in the central ballast bed portion under the track for excavating ballast from the central ballast bed portion and an ascending course for conveying the excavated ballast, and
  (3) a first ballast cleaning screen arranged to receive the conveyed ballast from the ascending course of the ballast excavating chain and to separate the ballast into a cleaned portion and a waste portion, (b) a second machine frame preceding the first machine frame in the operating direction and linked thereto, and mounted on the second machine frame
  (1) a ballast excavating device at each side of the track for excavating ballast from each ballast bed shoulder portion and for conveying the excavated shoulder ballast, (c) a second ballast cleaning screen preceding the first ballast cleaning screen in the operating direction and arranged to receive the conveyed ballast from the ballast excavating devices and to separate the ballast into a cleaned portion and a waste portion, (d) a respective ballast redistributing conveyor means arranged for receiving the cleaned ballast portion from each ballast cleaning screen and for redistributing the cleaned ballast portion in a respective one of the ballast bed portions behind the transverse ballast excavating chain course in the operating direction, and (e) a conveyor means arranged for selectively receiving the waste portions from the first and second ballast screens and for conveying the received waste portions forwardly in the operating direction along a conveying path, the conveyor means being mounted on the first and second machine frames and including
  (1) at least one laterally pivotal conveyor band and
  (2) the second ballast cleaning screen comprising a shaft arranged to receive oversized ballast rocks, the shaft forming a chute arranged in the conveying path extending from the first ballast cleaning screen along the machine frames forwardly in the operating direction for discharging onto a conveyor band of the waste portion conveyor means mounted under the second ballast screening screen.

2. The mobile machine arrangement of claim 1, wherein each ballast redistributing conveyor means comprises at least one conveyor band extending under a respective one of the ballast cleaning screens.

3. The mobile machine arrangements of claim 1, further comprising open-topped freight cars preceding the second machine frame in the operating direction and arranged to receive the forwardly conveyed waste portions from the conveyor means.

4. The mobile machine arrangement of claim 1, further comprising drive means linked to the ballast excavating chain and to the ballast excavating devices for vertically and laterally adjusting the chain and the devices with respect to the ballast bed, the track lifting device being arranged adjacent the transverse course of the chain.

5. The mobile machine arrangement of claim 4, further comprising control means connected to the drive means for adjusting the excavating depths of the ballast excavating chain and devices.

6. A mobile machine arrangement for excavating ballast from a ballast bed including a central portion supporting a railroad track and a respective shoulder portion at each side of the track, for cleaning the excavated ballast and for redistributing the cleaned ballast to the ballast bed, which comprises (a) a first, elongated machine frame supported for mobility on the track in an operating direction on two widely spaced undercarriages, and mounted on the first machine frame
  (1) a track lifting device,
  (2) a ballast excavating chain including a transverse course insertable in the central ballast bed portion under the track for excavating ballast from the central ballast bed portion and an ascending course for conveying the excavated ballast, and
  (3) a first ballast cleaning screen arranged to receive the conveyed ballast from the ascending course of the ballast excavating chain and to separate the ballast into a cleaned portion and a waste portion, (b) a second machine frame preceding the first machine frame in the operating direction and linked thereto, and mounted on the second machine frame
  (1) a ballast excavating device at each side of the track for excavating ballast from each ballast bed shoulder portion and for conveying the excavated shoulder ballast, (c) a second ballast cleaning screen preceding the first ballast cleaning screen in the operating direction and arranged to receive the conveyed ballast from the ballast excavating devices and to separate the ballast into a cleaned portion and a waste portion, (d) a respective ballast redistributing conveyor means arranged for receiving the cleaned ballast portion from each ballast cleaning screen and for redistributing the cleaned ballast portion in a respective one of the ballast bed portions behind the transverse ballast excavating chain course in the operating direction,
  (1) the second ballast cleaning screen and the ballast redistributing conveyor means being mounted on the first machine frame, and
  (2) the ballast redistributing conveyor means including a first conveyor band arranged under the first ballast cleaning screen rearwardly of the transverse ballast excavating chain course and connected to a drive for laterally pivoting the conveyor band for selectively redistributing the cleaned ballast portions in a respective one of the ballast bed portions while the track is lifted, and a second conveyor band arranged to receive the cleaned ballast from the second ballast cleaning screen for redistributing the cleaned ballast at least in the center ballast bed portion, the second conveyor band being displaceable in the direction of track elongation for placing a discharge end of the second conveyor band rearwardly of the transverse excavating chain course, and (e) a conveyor means arranged for selectively receiving the waste portions from the first and second ballast screens and for conveying the received waste portions forwardly in the operating direction along a conveying path, the conveyor means being mounted on the first and second machine frames and including
  (1) at least one laterally pivotal conveyor band 7. The machine arrangement of claim 6, wherein the first ballast cleaning screen has an output for discharging cleaned ballast onto the ballast bed after the track has been lowered onto the ballast bed comprised of the redistributed cleaned ballast.

8. The machine arrangement of claim 6, wherein the second conveyor band is laterally pivotal.

9. The machine arrangement of claim 6, wherein the second conveyor band is an endless band, and further comprising a reversing drive for moving the endless conveyor band in either direction.

10. A mobile machine arrangement for excavating ballast from a ballast bed including a central portion supporting a railroad track and a respective shoulder portion at each side of the track, for cleaning the excavated ballast and for redistributing the cleaned ballast to the ballast bed, which comprises (a) a first, elongated machine frame supported for mobility on the track in an operating direction on two widely spaced undercarriages, and mounted on the first machine frame
  (1) a track lifting device,
  (2) a ballast excavating chain including a transverse course insertable in the central ballast bed portion under the track for excavating ballast from the central ballast bed portion and an ascending course for conveying the excavated ballast, and
  (3) a first ballast cleaning screen arranged to receive the conveyed ballast from the ascending course of the ballast excavating chain and to separate the ballast into a cleaned portion and a waste portion, (b) a second machine frame preceding the first machine frame in the operating direction and linked thereto, and mounted on the second machine frame
  (1) a ballast excavating device at each side of the track for excavating ballast from each ballast bed shoulder portion and for conveying the excavated shoulder ballast, (c) a second ballast cleaning screen preceding the first ballast cleaning screen in the operating direction and mounted on the second machine frame to receive the conveyed ballast from the ballast excavating devices and to separate the ballast into a cleaned portion and a waste portion, (d) a respective ballast redistributing conveyor means arranged for receiving the cleaned ballast portion from each ballast cleaning screen and for redistributing the cleaned ballast portion in a respective one of the ballast bed portions behind the transverse ballast excavating chain course in the operating direction, the ballast redistributing conveyor means including (1) respective conveyor bands arranged under each ballast cleaning screen on the first and second machine frames, and (2) a vertically adjustable cleaned ballast portion separating device mounted on the first machine frame and extending between one of the undercarriages and the transverse ballast excavating chain course, pairs of flanged wheels supporting the cleaned ballast portion separating device for mobility on the track, the conveyor bands under the second ballast cleaning screen being arranged to redistribute the cleaned ballast portion received from the second ballast cleaning screen to the ballast bed center portion for intermediate storing while the track rests on the ballast bed, and the ballast separating device being arranged to receive the cleaned ballast portion from the conveyor bands under the second ballast cleaning screen and having a discharge end arranged to redistribute the received cleaned ballast portion behind the transverse ballast excavating chain course, and (e) a conveyor means arranged for selectively receiving the waste portions from the first and second ballast screens and for conveying the received waste portions forwardly in the operating direction along a conveying path, the conveyor means being mounted on the first and second machine frames and including (1) at least one laterally pivotal conveyor band

11. The machine arrangement of claim 10, wherein the second machine frame is comprised of a leading and a trailing part, the two parts being coupled together for laterally pivoting with respect to each other in a plane extending substantially parallel to the track, and the second machine frame is supported for mobility on the track on three undercarriages.

12. The machine arrangement of claim 10, wherein the shoulder ballast excavating devices are mounted on the leading machine frame part and the second ballast cleaning screen is mounted on the trailing machine frame part, the trailing machine frame part being coupled to the first machine frame, further comprising conveyor bands mounted on the leading machine frame part for respectively conveying the excavated shoulder ballast to the second ballast cleaning screen and for removing the waste portion from the second ballast cleaning screen, the ballast redistributing conveyor means including a conveyor band mounted on the trailing machine frame part under the second ballast cleaning machine and arranged to redistribute the cleaned ballast to the ballast bed center portion for intermediate storing, an operator's cab at an end of the trailing machine frame part and a facing end of the leading machine frame, and the ballast separating device being arranged on the first machine frame immediately preceding the ballast redistributing conveyor band under the first ballast cleaning screen in the operating direction.

* * * * *